US011370135B2

(12) United States Patent
Harrison

(10) Patent No.: US 11,370,135 B2
(45) Date of Patent: Jun. 28, 2022

(54) FIREFIGHTER'S AX

(71) Applicant: Stephen Harrison, Chico, CA (US)

(72) Inventor: Stephen Harrison, Chico, CA (US)

( * ) Notice: Subject to any disclaimer, the term of this patent is extended or adjusted under 35 U.S.C. 154(b) by 15 days.

(21) Appl. No.: 16/682,910

(22) Filed: Nov. 13, 2019

(65) Prior Publication Data

US 2020/0147816 A1 May 14, 2020

Related U.S. Application Data

(60) Provisional application No. 62/760,706, filed on Nov. 13, 2018.

(51) Int. Cl.
*B26B 23/00* (2006.01)
*A62B 3/00* (2006.01)

(52) U.S. Cl.
CPC ..... *B26B 23/00* (2013.01); *A62B 3/005* (2013.01)

(58) Field of Classification Search
CPC ..... B26B 23/00; A62B 3/005
USPC ..... D8/75–81; 30/308.1–310
See application file for complete search history.

(56) References Cited

U.S. PATENT DOCUMENTS

D20,247 S * 10/1890 Richardson ..... D8/75
684,098 A * 10/1901 Regan ..... B26B 23/00 30/308.1
700,780 A * 5/1902 King ..... B26B 23/00 30/308.1
771,419 A * 10/1904 Conover ..... B23D 47/02 30/164.8
1,265,276 A * 5/1918 Stephens ..... B26B 23/00 30/308.1
D57,334 S * 3/1921 Hanford ..... D8/78
1,517,043 A * 11/1924 Benson ..... B25D 1/04 30/123
1,679,814 A * 8/1928 Cicero ..... B26B 23/00 7/159
D118,700 S * 1/1940 Griffith ..... D8/78
D145,341 S * 7/1946 Thompson ..... D8/75
2,611,181 A * 9/1952 Coulter ..... A22C 25/025 30/308
2,794,251 A * 6/1957 Towne ..... B26B 23/00 30/308.1
2,798,292 A * 7/1957 Bishaf ..... B26B 23/00 30/308.1
3,219,316 A * 11/1965 Fried ..... B25F 1/00 30/308.1
D212,579 S * 10/1968 Hefner ..... D8/76
3,796,244 A * 3/1974 Florian ..... B25D 1/00 D8/78
D241,409 S * 9/1976 Lopizich ..... D8/81
4,242,780 A * 1/1981 Littman ..... B25D 1/00 D8/78
4,433,709 A * 2/1984 Porter ..... B26B 23/00 30/308.1

(Continued)

*Primary Examiner* — Jason Daniel Prone
(74) *Attorney, Agent, or Firm* — Dergosits & Noah LLP

(57) ABSTRACT

A combination tandem cutting ax head and adz is disclosed that is adapted to firefighting. The ax may include a front end that is divided between a concave portion and a flat section. The concavity creates edges for cutting through surfaces, while the flat section functions to hinder the ax head from becoming wedged in the material. An adz may be provided in which the fulcrum is raised above the head and located between the handle and the adz edge, which increases the lever arm.

17 Claims, 8 Drawing Sheets

(56) References Cited

U.S. PATENT DOCUMENTS

| | | | | | |
|---|---|---|---|---|---|
| 5,027,677 | A * | 7/1991 | Rallo | B25D 1/00 | 81/26 |
| D398,505 | S * | 9/1998 | Gossage | D8/78 | |
| D443,191 | S * | 6/2001 | Whiting | D8/75 | |
| D497,789 | S * | 11/2004 | Hung | D8/78 | |
| D522,340 | S * | 6/2006 | Hung | D8/76 | |
| D530,583 | S * | 10/2006 | Chen | D8/78 | |
| D549,065 | S * | 8/2007 | Chen | D8/76 | |
| D549,540 | S * | 8/2007 | Chen | D8/76 | |
| D550,055 | S * | 9/2007 | Chen | D8/78 | |
| 7,350,440 | B2 * | 4/2008 | Casolco | B25D 1/045 | 81/20 |
| 7,472,484 | B2 * | 1/2009 | Smilanich | B26B 23/00 | 30/308.1 |
| D644,082 | S * | 8/2011 | LeMacher | D8/78 | |
| D648,611 | S * | 11/2011 | Chen | D8/78 | |
| 8,141,458 | B1 * | 3/2012 | Spencer | B25D 1/00 | 81/20 |
| 8,177,192 | B1 * | 5/2012 | Taylor | B25D 1/045 | 81/20 |
| D723,348 | S * | 3/2015 | Preston | D8/76 | |
| D741,679 | S * | 10/2015 | White | D8/75 | |
| D795,667 | S * | 8/2017 | Chen | D8/79 | |
| 10,124,478 | B2 * | 11/2018 | Nicholls | B26B 23/00 | |
| D840,780 | S * | 2/2019 | Pacheco, III | D8/81 | |
| 2004/0244545 | A1 * | 12/2004 | Stinnissen | B25D 1/04 | 81/489 |
| 2008/0264211 | A1 * | 10/2008 | Unda | B25D 1/045 | 81/22 |
| 2018/0297188 | A1 * | 10/2018 | McCann | B26B 23/00 | |

* cited by examiner

FIREFIGHTER'S AX

CROSS REFERENCE TO RELATED CASES

This application claims priority to U.S. Provisional Patent Application No. 62/760,706, entitled "FIREFIGHTER'S AX," filed Nov. 13, 2018, which is incorporated in its entirety.

TECHNICAL FIELD

The subject matter relates to the field of hand tools, and more particularly to hand tools used to gain entry in emergency situations.

BACKGROUND

Firefighters constantly save people, animals, and possessions from uncontrollable fires that tear down man-made objects and structures. With objects like buildings, cars, busses, boats, trains, elevators, structures, and the like, there exists the possibility that they may catch fire and trap people, animals, and possessions inside. Every instance in which a person or animal is trapped in a man-made enclosure that is on fire is unique. Every such instance is unique because every place where a fire occurs is unique based on the type of enclosure, the integrity or composition of the enclosure, the placement of the enclosure, the altitude of the enclosure, the nature of the enclosure, etc. Since every instance is different, firefighters are constantly faced with new obstacles in their path to reach and save people, animals, and possessions. These obstacles include the man-made objects and the structural changes that have developed over the years in the construction of those objects.

Historically, such things were constructed from a limited group of materials. For example, buildings were made of brick or wood, cars were made of metal, and boats were made of wood or metal. With this limited selection of materials there was no significant need to change the embodiment of the traditional firefighter ax or adz because the application for which firefighter axes and adzes were used tended to fall within a limited range of circumstances and against a limited group of materials.

In the present time, however, objects and structures may be made using advanced processes and materials. And there is a more widespread social awareness of the scarcity of resources, which has resulted in people considering the health of the natural environment in both materials selections and building procedures, which further diversifies the materials used in the construction of objects and structures. Thus, many of today's objects and structures are constructed from materials that are vastly different from the materials traditionally encountered when combating fires.

For example, buildings are now rarely made only of wood or bricks but instead may be made from a large selection of materials like wood from all over the world with varying degrees of strength, brick made from natural resources coming from different types of landscapes and have different characteristics for different purposes, different types of metals, concrete mixtures that vary in composition depending on the purpose the concrete is meant for, and many other materials. Since the materials being used for building are different from the materials traditionally used, there is a need for a way to gain entry that addresses the new materials.

Since the man-made structures and objects that firefighters must break through to save people and animals are constantly changing, the traditional sharp-edged ax with a curved front-end blade has become less universally efficient at piercing and breaking through the materials encountered when fighting fires. The inefficiency of the traditional ax has caused inefficiency in the attempts to save people, animals, and possessions from fires. This is also true for the firefighter adz tool, which has traditionally been used for prying open objects and structures. Thus, there is a need for a tool that addresses the change in construction materials so that firefighters may more easily gain entry or access to structures and objects.

BRIEF SUMMARY

In an embodiment, the present disclosure comprises a novel tandem ax and adz tool. The head of the ax and adz tool includes an ax blade face where a majority portion of the face is concave and the minority portion of the face is flat. In the embodiment, the majority portion of the face that is concave can range from a high 90% to a low 50% of the blade so as to create a tandem edge for efficient cutting through hollow objects. In other words, in the embodiment, the concave portion is at least greater than half the length of the ax blade face. In the embodiment, the remaining minority portion of the ax blade face is flat so that the concave portion of the front-end ax blade does not wedge itself into an object resulting in less efficient use of the tool. Thus, the minority portion of the ax blade face that is flat ranges from a 0% to high 40% of the length of the blade. In the embodiment, the concave portion ranges from a width of ¾ inch to a low ¼ inch. Also, in the embodiment, the sides of the concave portion are blunt when compared to the sharpness of a knife. Due to the abuse the ax will take, a larger and heavier ax will generally perform better with a blunter edge when compared to a smaller and lighter ax that will have a sharper edge, since the larger and heavier ax will be subject to greater force impacts on the front-end ax blade.

In an embodiment, the head of the ax and adz tool may also have a rear-end adz that is the highest point on the tool, above the ax head and the handle, which provides a fulcrum nearer the adz edge, creating a better lever arm for prying objects open.

In an embodiment, the head of the ax and adz tool may be integrally formed using the same, uniform material. The head may thus include an ax end and an adz end.

In an embodiment, the material is a metal or metalloid, preferably a high-grade tool steel treated to a Rockwell hardness of HRC 5-58.

In an embodiment, the ax and adz tool handle may be made from a material such as wood, metal, fiberglass, or carbon fiber. The handle may have an upper section that is adjacent to the lower bottom of the head. The handle may be secured to the head by a reinforcing means such as a strong adhesive, a clamp, heating the ax and adz head such that the receiving hole expands and inserting a metal handle so that when the entire tool cools the head is thermally clamped upon the handle, an adhesive and pin setup, a weld surrounding the entire metal handle and metal head, a series of TIG welds around the circumference of the handle and hole of the head, and any other means that can strengthfully secure a handle to a weighted metal/metalloid head used for striking hard and dense objects. The handle may be made of a fiberglass material that has a tested breaking strength of greater than 10,000 pounds of force.

In an embodiment in which the handle is made from fiberglass, it is preferable that the fiberglass handle be secured to the head by a two-part high-pressure heat resistant epoxy. Furthermore, the handle may be secured to the ax and adz tool head by application of an epoxy that cements the handle to the head at the surfaces of contact between the handle and a hole in the head dimensioned to receive the handle.

BRIEF DESCRIPTION OF THE DRAWINGS

The embodiments are illustrated by way of example and not limitation in the figures of the accompanying drawings, in which like references indicate similar elements, and in which.

DETAILED DESCRIPTION OF THE INVENTION

The inefficiency of the traditional ax has called for the further development of the ax and the adz as life-saving, rescue tools. A new tool that incorporates an ax and an adz is disclosed and discussed herein. The present disclosure is to be considered as describing an example of one embodiment of the invention and is not intended to limit the invention to the specific embodiments illustrated by the figures or description below. The present invention is described by referencing the figures provided in this document.

Embodiments of an ax and adz tool may allow rescuers to more easily gain access to compartments where people, animals, and possessions are trapped. In embodiments, the ax includes a face with an upper part with two cutting edges and a center concavity and a lower part with a flat surface. The upper part may allow rescuers to more efficiently penetrate the surface of construction materials, while the lower part may hinder or prevent the ax from becoming wedged within the surface. In embodiments, the adz portion of the ax may allow rescuers to more efficiently pry open objects and structures by including a fulcrum further away from the bottom of the handle so that the user of the adz of the present disclosure has more leverage in prying open an object or structure. Thus, in embodiments, the disclosed hand tool overcomes the deficiencies of the traditional sharp-edged ax and adz in light of today's advanced materials and construction techniques.

Figure 1:
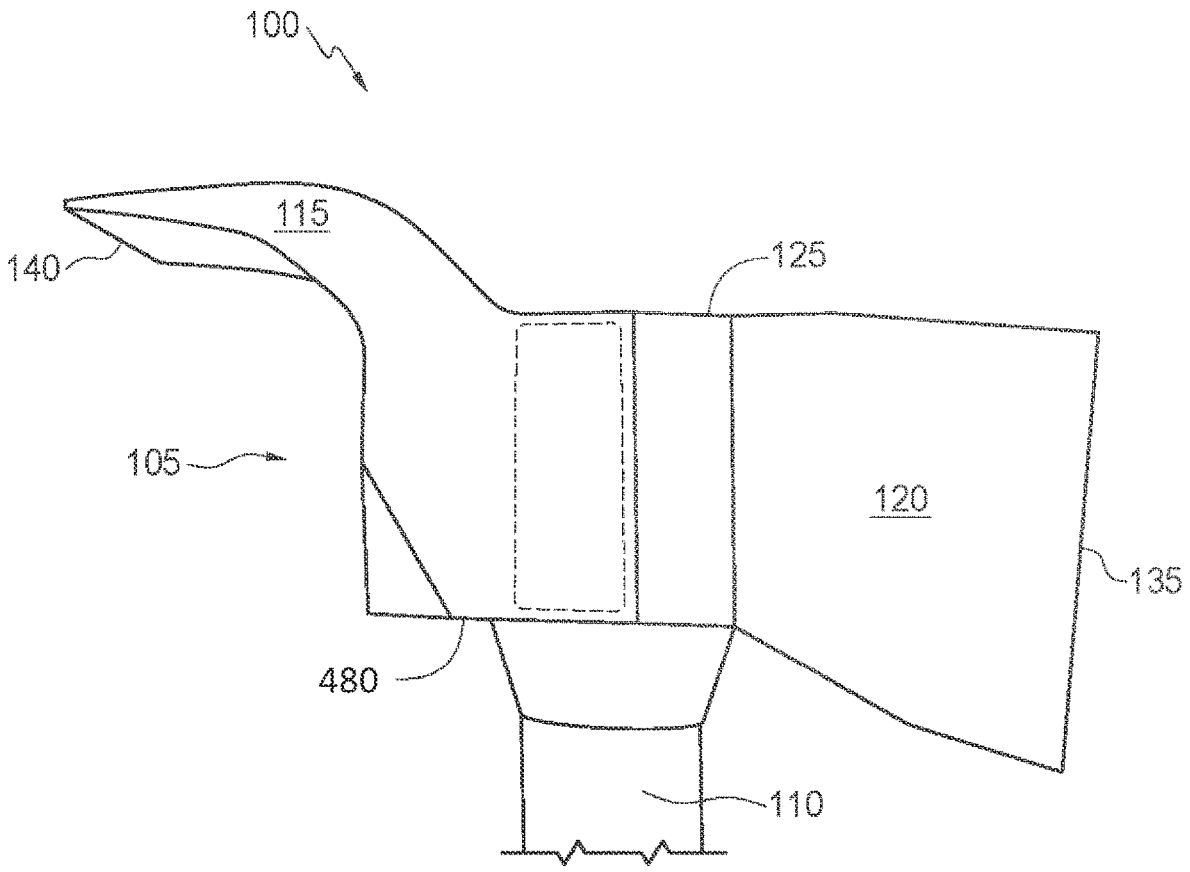
FIG. 1 illustrates a right-side perspective view of an embodiment of a hand tool.

FIG. 1 illustrates a right-side perspective view of an embodiment of a hand tool 100 including a head 105 and a handle 110. In FIG. 1, head 105 is facing right. Head 105 includes an adz blade 115 and an ax blade 120. Handle 110 extends from a bottom 480 of head 105. Adz blade 115 extends above a top 125 of head 105. Ax blade 120 ends with an edge 135. Edge 135 includes a face where a majority portion of the face is concave and the minority portion of the face is flat. In the embodiment, the concavity is bounded by edges, which creates a face that efficiently cuts through objects, e.g., hollow objects. In the embodiment, the concave portion may be at least half the length of the ax blade face. In the embodiment, the remaining minority portion of the face is flat, which resists penetrating a surface, so that the ax blade does not wedge itself into an object resulting in less efficient use of the tool. Adz blade 115 ends with an edge 140. Adz blade 115 is provided to pry open hefty objects and structures, which may the application of thousands of pounds of force due, e.g., to the nature of the object and its structure, or due to the nature of the situation, as when a car is crushed by a boulder, pinning the occupants within.

In an embodiment, the majority portion of the face that is concave may range from a high of 90% to a low of 50% of the blade, In the embodiment of FIG. 1, edge 135 is at an angle with respect to handle 110 such that the upper corner of edge 135 at top 125 extends further right than the lower corner of edge 135. In this configuration, when the tool is swung toward a target the upper corner of edge 135 is more likely to make first contact with the target than then lower edge. In the embodiment, edge 135 is in-line with handle 110 and edge 140 is rotated with respect to edge 135 and handle 110 such that edge 140 is at a right angle to edge 135 and handle 110. In the embodiment, adz 115 extends above top 125 such that the curved part of adz 115 may be the fulcrum between 140 and handle 110, which provides more leverage than if the fulcrum were further along top 125 toward edge 135. In the embodiment, handle 110 is retained within a hole through head 105.

In an embodiment, edge 135 may be parallel to handle 110. In the embodiment the head is facing up on the page where the ax portion is facing the top of the page and the adz is facing the bottom of the page. In an embodiment, edge 140 may be rotated with respect to edge 135 at an angle other than a right angle. In an embodiment, edge 140 may be in-line with top 125 with adz 115 still extending above top 125 and providing a fulcrum on which the head may pivot when using edge 140 to pry. In an embodiment, handle 110 may be attached to head 105. For example, handle 110 may be made of metal and welded to head 105.

Figure 2:
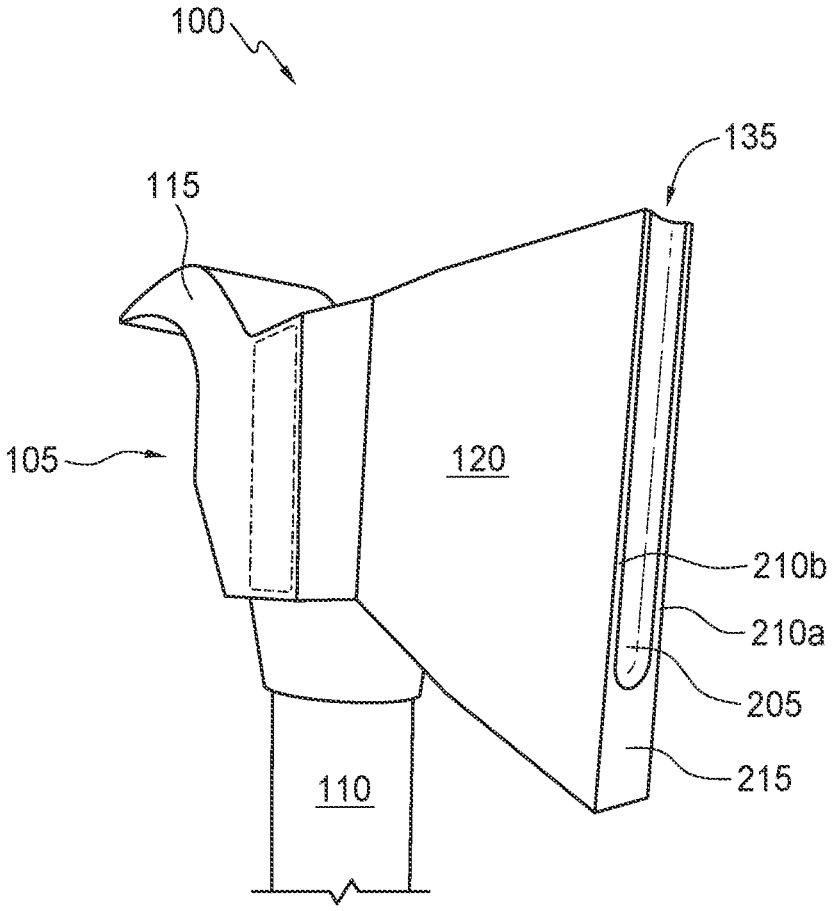
FIG. 2 illustrates a right-front perspective view of an embodiment of a hand tool.

FIG. 2 illustrates a right-front perspective view of the embodiment of hand tool 100. In FIG. 2, edge 135 is shown to have a concavity 205 between an edge 210*a* and an edge 210*b*. Edge 135 further includes a flat section 215 below the concavity. In the embodiment, edges 210*a*, 210*b* are not sharp. Rather, they are flat, squared-off edges, or otherwise blunt. Yet in the embodiment, edges 210*a*, 210*b* are considered cutting edges because they provide the ability to pierce a surface. Flat section 215 does not include cutting edges and resists penetration into a surface. Thus, the combination of edges 210*a*, 210*b*, and flat 215 provide for using hand tool 100 to pierce a surface, but not penetrate the surface to the extent that ax blade 120 becomes fully embedded in the surface and difficult to withdraw.

In an embodiment, edges 210*a*, 210*b* may be sharp. In an embodiment, concavity 205 may be a groove that is V-shaped in cross-section.

Figure 4:
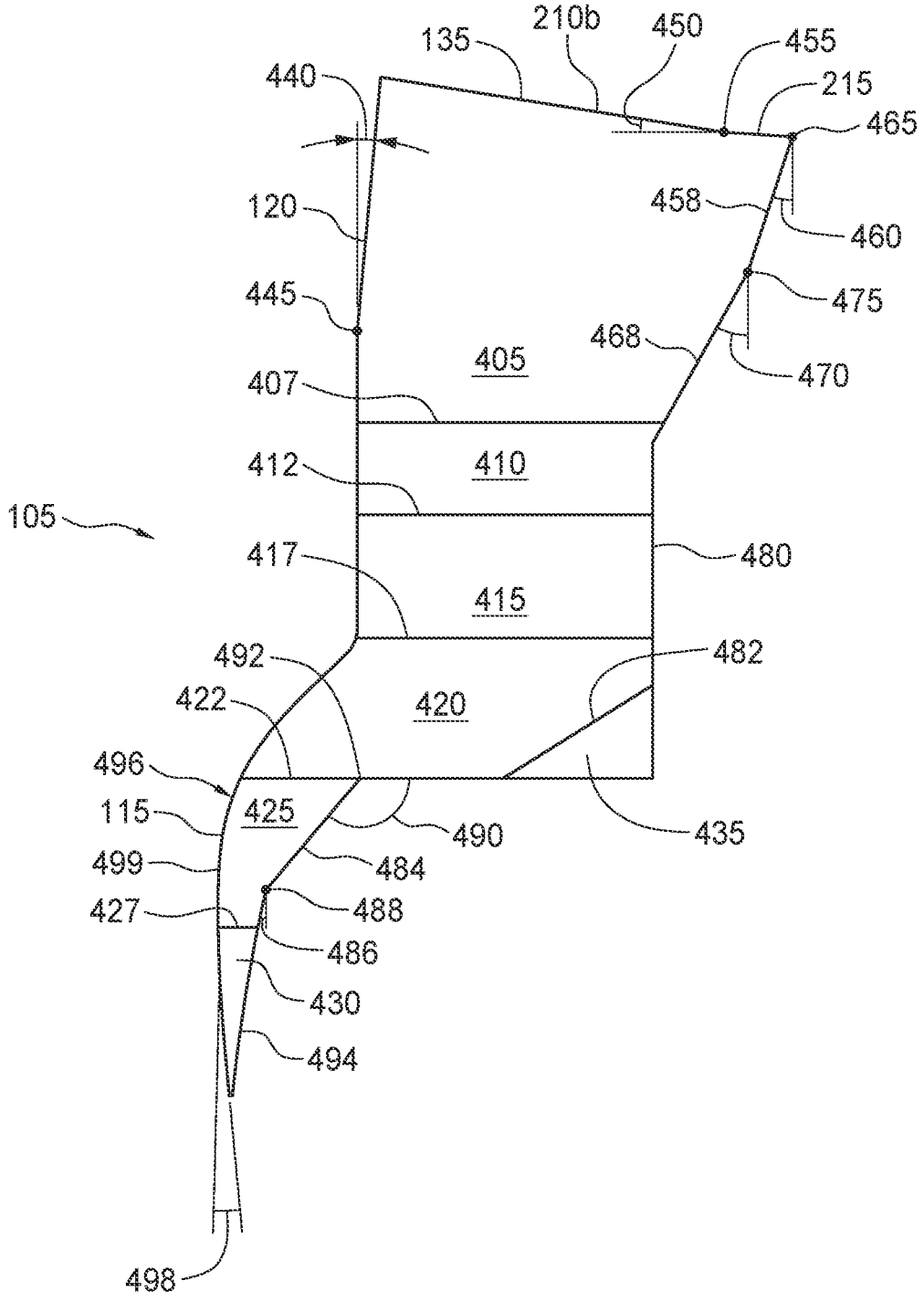
FIG. 4 illustrates a right-side view of an embodiment of a hand tool.

Now, considering FIG. 1 and FIG. 2, in an embodiment, head 105 for hand tool 100 (e.g., an ax) comprises a handle section dimensioned to accommodate handle 110 extending from the handle section. Head 105 includes blade 120 extending from the handle section and terminating with edge 135 (or a "face" 135), the face including: flat section 215, and a grooved section including groove 205 between edge 210*a* and edge 210*b*. In the embodiment, flat section 215 defines a first plane, and edge 210*a* and edge 210*b* of the grooved section define a second plane. As shown in FIG. 4, the second plane is at an angle with respect to the first plane such that the grooved section extends further away from the handle section than the flat section. In the embodiment, adz 115 is attached to the handle section and extends away from the handle section and the blade 120, with adz 115 terminating in edge 140, which is at a right angle with respect to edge 210*a* and edge 210*b*. Adz 115 also extends opposite handle 110 such that part of adz 115 extends beyond ("above" in FIG. 1 and FIG. 2) both the handle section and the blade 120.

In an embodiment, head 105 does not include an adz 115.

Figure 3:
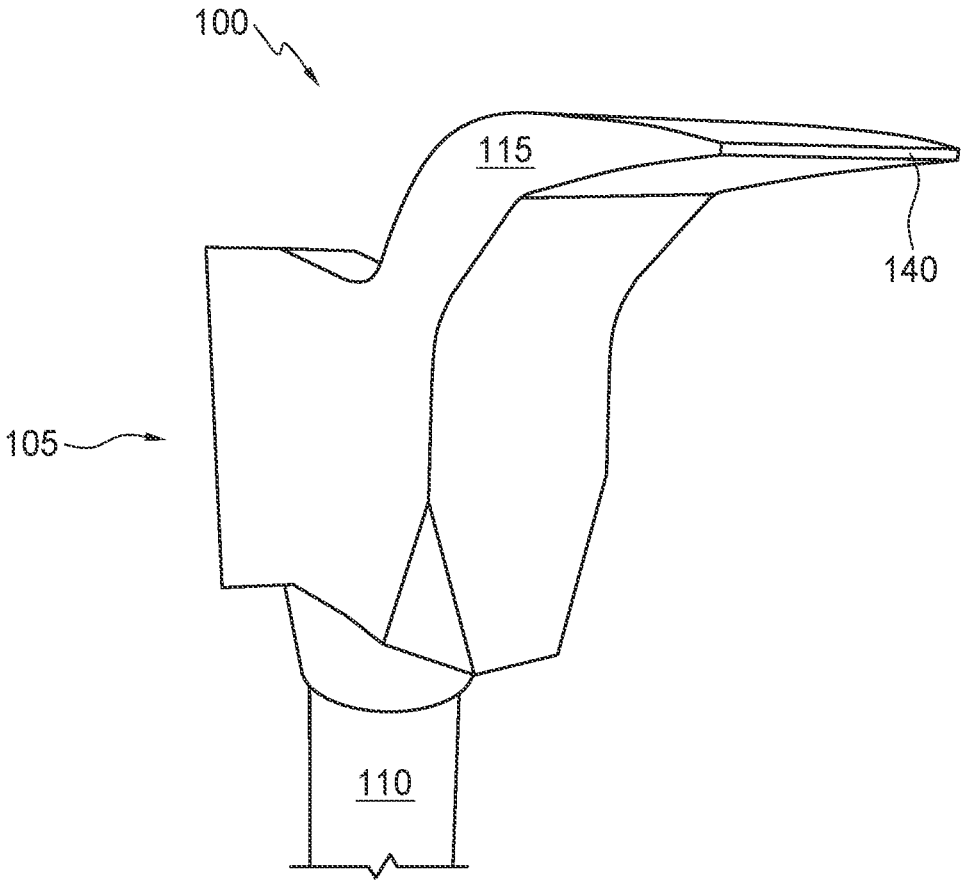
FIG. 3 illustrates a left-rear perspective view of an embodiment of a hand tool.

FIG. 3 illustrates a left-rear perspective view of the embodiment of hand tool 100. In FIG. 3, head 105 is facing into the page and is rotated slightly to the left. From this perspective, it can be seen that adz 115 is the upper-most section of head 105, with adz 115 rising up from head 105 past the handle section and curving to terminate in edge 140. In the embodiment, head 105 may be fabricated from a metal or metalloid material.

FIG. 4 illustrates a right-side view of the embodiment of head 105. In the embodiment, the left and right sides are mirror images of each other. In FIG. 4, ax blade 120 is facing upwards on the page such that handle 110 (if shown) would extend from a head bottom 480 to the right of the page. FIG. 4 depicts head 105 in more detail. In the embodiment, head 105 includes a flat blade section 405, a flat handle section 410, a flat handle section 415, a flat adz section 420, a flat adz section 425, a flat adz section 430, and a flat adz section 435. Transition lines 407, 412, 417, 422, 427, 482 indicate the where one flat section transitions to another. In the embodiment, ax blade 120 includes flat blade section 405, adz blade 120 includes flat adz sections 420, 425, 430, 435 and handle 110 is retained within flat handle sections 410, 415.

FIG. 4 further illustrates various angles. In the embodiment, a blade drop angle 440 indicates an angle that ax blade 120 is angled downward at an initial point 445 from head top 125. A blade edge angle 450 indicates an angle that edge 210*a* and edge 210*b* angle up at an initial point 455 from flat 215. A blade lower drop angle 460 indicates an angle that a blade bottom flat 458 angles up from an edge lower point 465. A blade lower drop angle 470 indicates an angle that a blade bottom flat 468 angles up from an edge lower point 475. In the embodiment, adz blade 115 includes and adz bottom flat 484 that is at an angle 490 flat adz section 420 at an angle initial point 492. An adz flat 494 is at an angle 486 from adz flat 484 at angle initial point 488. Adz 115 has an upper radius 496 defining the curve of adz 115 along the upper surface of flat adz section 420 and flat adz section 425. Adz 115 tapers to adz edge 140 according to an angle 498 of the upper surface of adz flat section 430 from an initial angle point 499.

In FIG. 4, blade edge angle 450 illustrates that edge 210*a* and edge 210*b* are not co-planar with flat 215. As discussed earlier, ax edge 135, which includes edges 210*a*, 210*b*, extends further from handle 110 so that edge 135 will strike and penetrate a surface at the upper corner of ax blade 120. As edge 135 further penetrates the surface, eventually ax edge flat 215 will encounter the surface. Since edge flat 215 does not include cutting or penetrating edges such as edges 210*a*, 210*b*, flat 215 will hinder the further penetration of blade 120 into the surface. Thus, head 105 may be used to cut a surface while not penetrating the surface so much that it becomes difficult to remove from the surface. This provides the hand tool with the ability to cut the surface and be quickly removed from the surface for another strike, which increases the cutting speed and makes hand tool 100 a valuable asset in certain emergencies.

In FIG. 4, the forward-angled orientation of edges 210*a* and 210*b* means that the top corner of edges 210*a*, 210*b* strike the target first, which concentrates the energy of the impact in the top corners of 210*a*, 210*b* and increases the probability that the initial strike will, in fact, cut through the target surface. That concentrating effect continues as edges 210*a*, 210*b* slice further into the surface. As edges 210*a*, 210*b* slices further into the surface, the point of contact moves from the top corner toward angle initial point 455. When the point of contact reaches initial point 455, the angle of flat 215 means that most or all of flat 215 will strike the target surface simultaneously. Thus, most or all of the area of flat 2115 resists further penetration into the surface, and reducing or eliminating any further penetration. In the embodiment, flat 215 is parallel to handle 110.

In other embodiments, flat 215 may be angled with respect to handle 110 such that end point 465 is further from handle 110 than initial point 455. Such an angle may make flat 215 more effective when handle 110 is itself at an angle with the target surface when head 105 makes contact. Thus, in an embodiment, flat 215 is angled such that flat 215 is parallel to the target surface when head 105 penetrates the target surface enough to bring flat 215 in contact with the target surface. In such an orientation the maximum area of flat 215 will come into contact with the target surface and be most effective in preventing further penetration.

Figure 5:
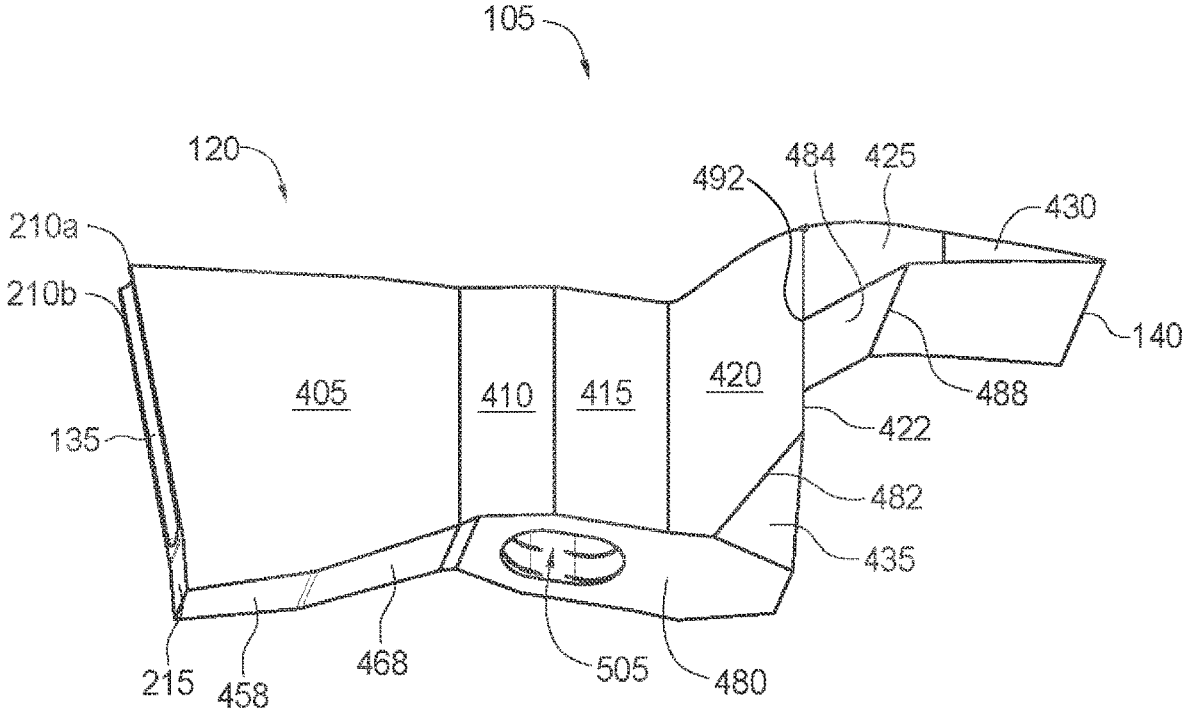
FIG. 5 illustrates a bottom-left perspective view of an embodiment of a hand tool.

FIG. 5 illustrates a bottom-left and slightly front perspective view of head 105 of the embodiment of hand tool 100. In FIG. 5, edge (or "face") 135 is further illustrated, showing how the upper corner of edge 135 is extended further away from flat handle sections 410, 415. Also, FIG. 5 shows the relative angle between edges 210*a*, 210*b* and flat 215. FIG. 5 also illustrates that in this embodiment the left and right sides of head 105 are mirror-images by using the same element numbers as used in FIG. 4 for the right side of head 105. In FIG. 5, head 105 includes a hole 505, into which handle 110 may be secured. FIG. 5 illustrates that the sections of head 105 have various thicknesses (as measured more or less perpendicularly from the page), generally decreasing in thickness from a maximum at adz edge 140 to a minimum at ax edge 135. The thickness of head 105 generally decreases from a thickness about hole 505 to a thickness at edge 135. Also, the height of head 105 generally increases from flat handle sections 415, 410 to edge 135. As discussed, flat 215 slows the surface-piercing edges 210*a*, 210*b* to prevent the ax from fully penetrating the surface. Flat 215 stops the ax from wedging itself into the object since it does not include edges 210*a*, 210*b*, separated by edge concavity 205 (or "groove" 205), that if continued across the entirety of edge 135 would pierce and penetrate the target surface.

In an embodiment, flat 215 may be angled further forward (at the bottom) to be more fully in contact with the target surface and further prevent the ax from wedging into different materials. In an embodiment, the thickness of blade 120 may be uniform from an attachment point near handle 110 to edge 135.

Figure 6:
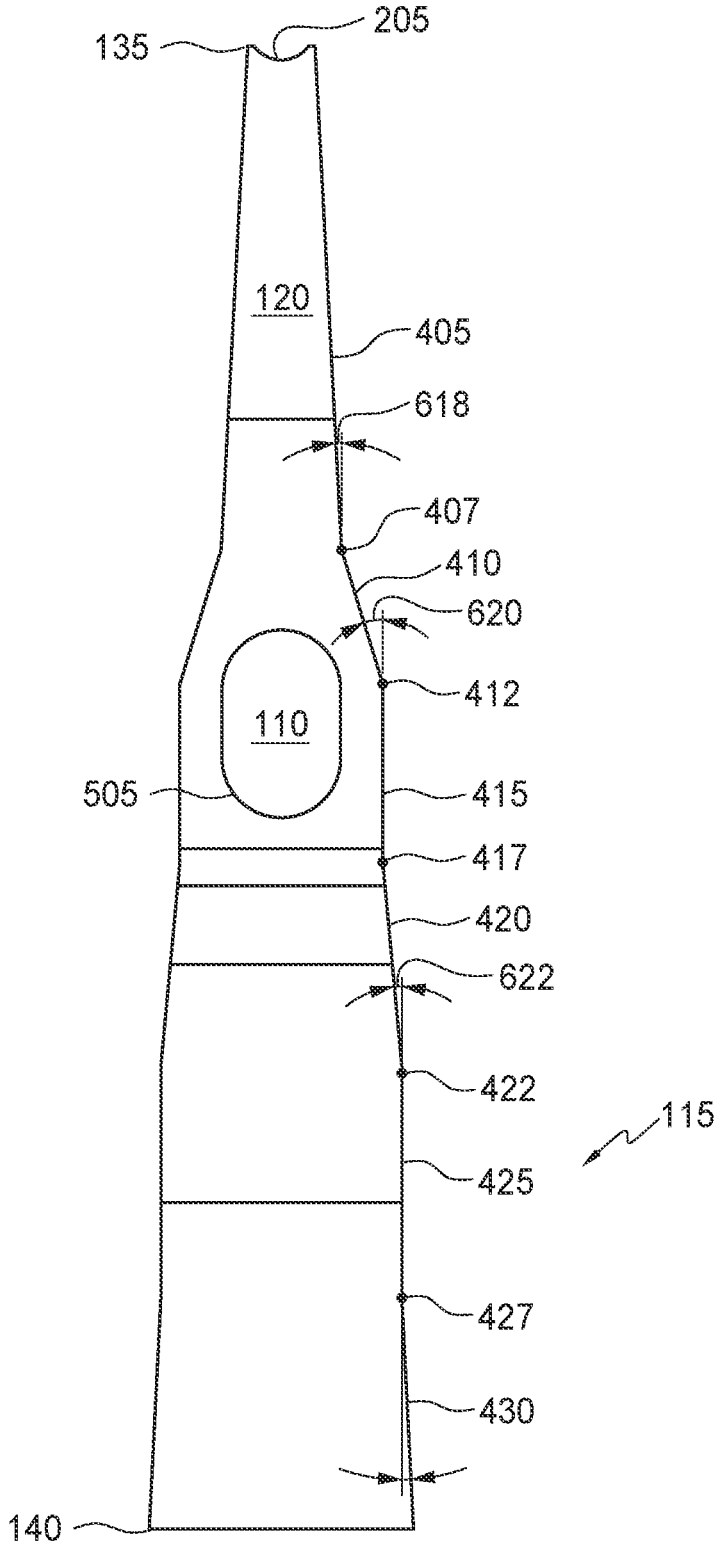
FIG. 6 illustrates a top view of an embodiment of a hand tool.

FIG. 6 illustrates a top view of head 105 of the embodiment of hand tool 100. In FIG. 6, hole 505 is perpendicular to the plane of the page, indicating the direction of handle 110. FIG. 6 illustrates the hole 505 is stadium-shaped which will resist rotation of handle 110. Hole 110 is dimensions such that handle 110 will fit within and be rigidly and securely connected to head 105. FIG. 6 illustrates the narrowing of head 105 from adz edge 140 to ax edge 135.

From adz edge 140, adz flat 430 narrows by an angle 624, ending at transition line 427. Adz flat section 420 narrows at an angle 622 from transition line 422 to line 417. Handle flat section 410 narrows at an angle 620 from transition line 412 to line 407. And blade flat section 405 narrows at an angle 618 from transition line 407 to edge 135. As shown in the embodiment of FIG. 6, edge concavity 205 is an arc in cross-section. In the embodiment, as with flat 215, the increasing thickness of blade 120 as it nears handle 110 also hinders the penetration of blade 120 into a surface.

In some embodiments, the depth of concavity 205 may range from 1/16 inch deep to 1/2 inch deep. In some embodiments, each edge 210*a*, 210*b* is not less than 1/32 inch and is not greater than 1/8 inch wide, meaning that each tandem edge is blunt and not sharp compared to a knife. In other embodiments, the depth of concavity may vary because the wider head 105 is, the deeper concavity 205 may be.

In an embodiment, head 105 may be (measured either parallel or perpendicularly to handle axis): 1) 10.9 inches from adz edge 140 to ax edge 135; 2) 7.5 inches from upper corner of edge 135 to transition line 422; 3) 3.4 inches from transition line 422 to adz edge 140; 4) 1.6 inches from transition line 417 to transition line 422; 5) 3.6 inches from transition line 407 to transition line 417; 6) 5.9 inches tall from initial point 465 to adz edge 140; 7) 0.5 inches tall from initial point 465 to initial point 455; 8) 3.8 inches tall from initial point 455 to the upper corner of ax edge 135; 9) 4) 3.2 inches tall at hole 505; 10) 4.4 inches tall from bottom face 480 to adz edge 140; 11) 2.2 inches tall from initial point 492 to adz edge 140; 12) 1.9 inches wide at adz edge 140; 13) 0.4 inches wide at ax edge 135; and 14) concavity 205 has a radius of 0.25 inches.

In an embodiment, the arc of edge concavity 205 may be replaced with a triangularly-shaped groove between edges 210*a*, 210*b* to provide a triangularly-shaped concavity. In an embodiment, the concavity may have a cross-section that has a flat bottom and flat sides, such that the concavity is square-ish. In embodiments, the concavity may have other cross-sectional shapes, including irregular shapes. In embodiments, the cross-sectional shape of the concavity may vary along its length.

Figure 7:
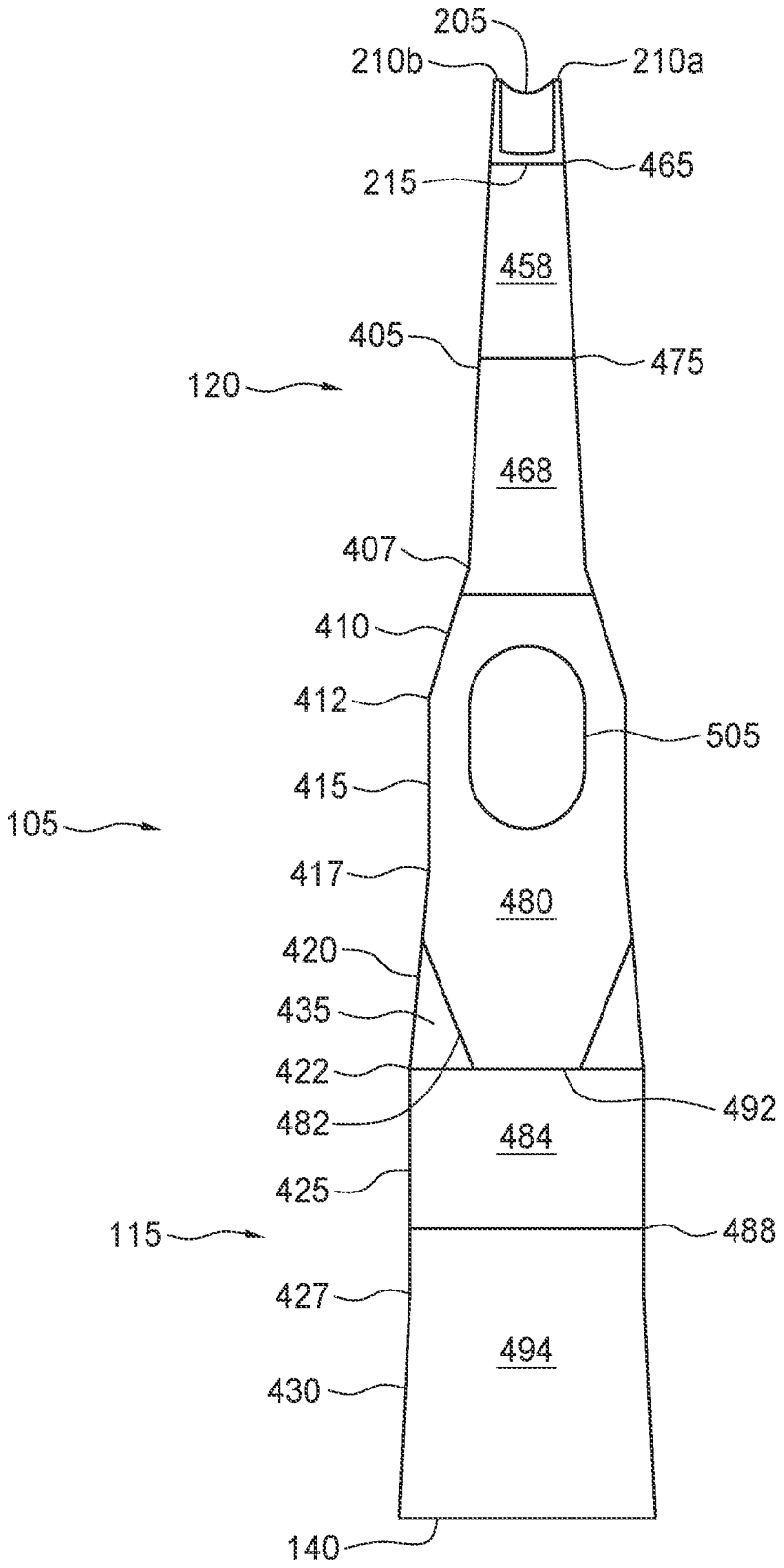
FIG. 7 illustrates a bottom view of an embodiment of a hand tool.

FIG. 7 illustrates a bottom view of an embodiment of head 105 of hand tool 100. In FIG. 7, head 105 is again oriented so that hole 505 is perpendicular to the page, however in FIG. 7 handle 110, if shown, would extend out of the page. In FIG. 7, it can be seen that flat 215 is also perpendicular to the page and is thus oriented similarly to handle 110.

Figure 8:
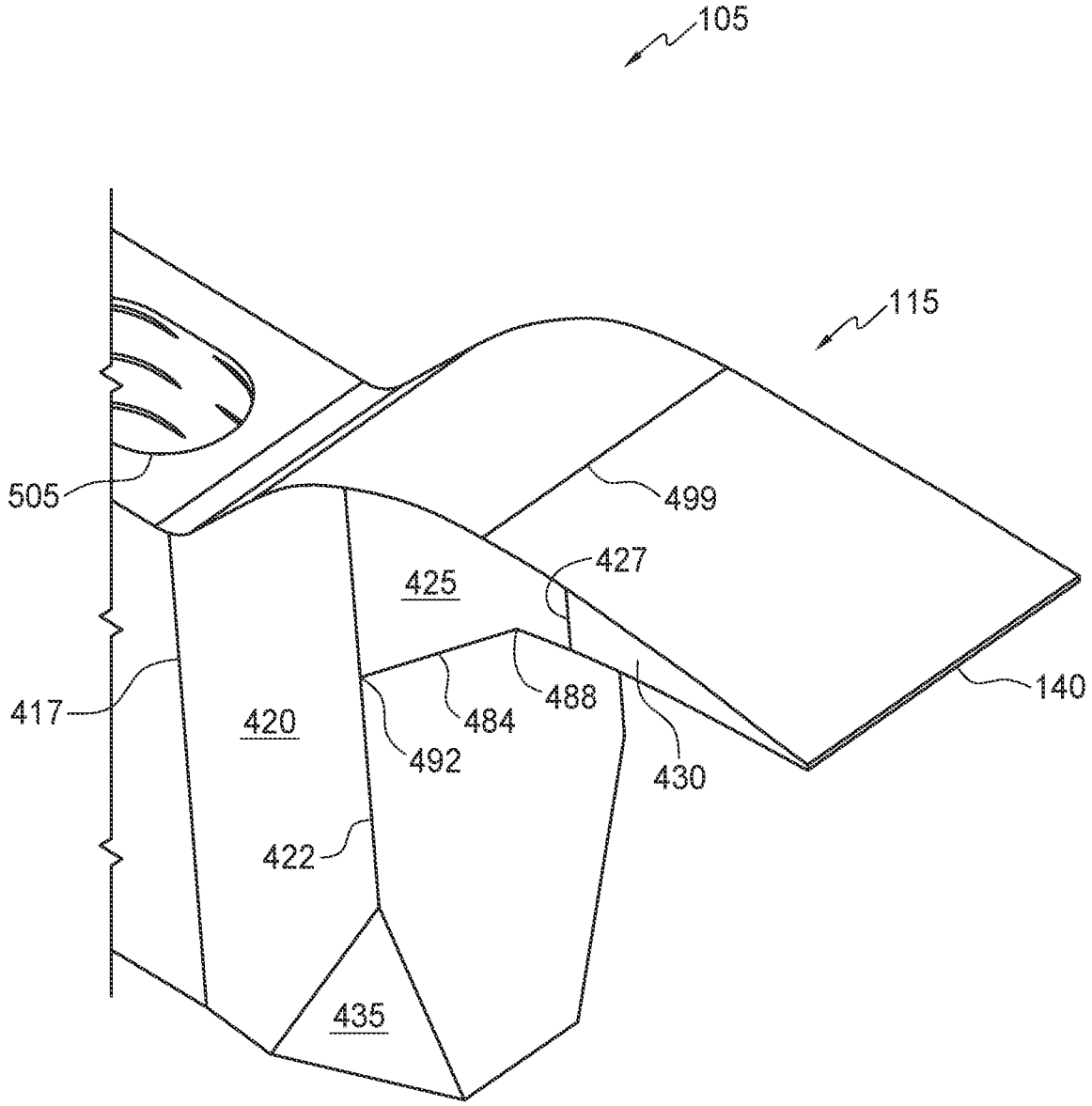
FIG. 8 illustrates a top-left-rear perspective view of an embodiment of a hand tool.

FIG. 8 illustrates a top-left-rear perspective view of head 105 of the embodiment of hand tool 100. FIG. 8 illustrates that adz blade 120 rises above the rest of head 105. Thus, adz blade 120 creates a fulcrum at, e.g., angle initial point 499, that provides for a better lever arm in comparison to the rest of head top 125, which is further away from edge 140. In the embodiment, adz sections 420, 425 are dimensioned and fashioned from material to be strong enough that adz blade 115 does not break off despite experiencing thousands of pounds of force and impact.

The embodiment of head 105 illustrated in FIG. 1 through FIG. 8 shows a number of flat sections, transition points, angles and radii. In other embodiments, the dimensions and shapes of the various sections of head 105 may be modified without departing from the subject matter.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will further be understood that the terms "comprises" and/or "comprising," when used in this specification, specify the presence of states features, steps, operations, elements, and/or components, but do not preclude the present or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will further be understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. The specification and claims should be read with the understanding that such combinations are entirely within the scope of the invention and the claims.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples and are not meant to be limiting in any way. Other steps and functions may be contemplated without departing from this disclosure or the scope of an embodiment.

What is claimed is:

1. A head for an ax, the head comprising:

A handle section including a structure, the structure defining a central axis and configured to accommodate a handle extending from the handle section in a first direction parallel to the central axis;

a blade section extending from the handle section and terminating with a work piece engaging face, the face including: a flat section, and a grooved section including a groove between a first edge and a second edge, wherein:

the flat section defines a first plane, the first edge and the second edge of the grooved section define a second plane, the second plane is at an angle with respect to the first plane such that the grooved section extends further away from the handle section than the flat section; and an adz section attached to the handle section and extending away from the handle section and the blade section, the adz section terminating in a third edge at a right angle with respect to the first edge and the second edge, the adz section also extending opposite the first direction such that at least part of the adz section extends beyond both the handle section and the blade section.

2. The head of claim 1, wherein a length of the flat section is at least ten percent of a length of the grooved section and no greater than fifty percent of the length of the grooved section.

3. The head of claim 1, wherein:

a cross-section of the groove between the first edge and the second edge is one of:

rounded, or v-shaped; and either or both the first edge and the second edge are one of: flat, blunt, or sharp.

4. A head for a hand tool, the head comprising:

a first section having a first thickness and a structure, the structure defining a central axis and configured to accommodate a handle extending from the head in a first direction parallel to the central axis; and a second section extending from the first section and terminating with a face at an end of the second section distal to the first section, the face including: a flat section, and a grooved section including a concavity between a first edge and a second edge, wherein the first edge and second edge define a second axis midway between the first edge and second edge and parallel to the first edge and second edge such that the second axis intersects the central axis.

5. The head of claim 4 further comprising:

a third section attached to the first section and extending away from the first section and the second section, the third section terminating in a third edge that is not parallel to the first edge and the second edge, the third section also extending in a second direction opposite the first direction such that at least part of the third section extends beyond both the first section and the second section in the second direction.

6. The head of claim 5, wherein the third edge is skew in relation to the first edge and the second edge and central axis.

7. The head of claim 4, wherein the flat section defines a first plane and the first edge and the second edge of the grooved section define a second plane and the first plane is at an angle with respect to the second plane.

8. The head of claim 7, wherein the first plane is parallel to the first direction and the second plane is angled with respect, to the first plane such that the grooved section extends further from the first section than the flat section.

9. The head of claim 8, wherein a length of the flat section is at least ten percent of a length of the grooved section and no greater than fifty percent of the length of the grooved section.

10. The head of claim 4, wherein:

a cross-section of the concavity between the first edge and the second edge and perpendicular to the second axis is one of: rounded, or v-shaped; and either or both the first edge and the second edge are one of: flat, blunt, or sharp.

11. A hand tool comprising:

a head; and a handle, the head including:

a first section having a first thickness and including a structure, the structure defining a central axis, and a second section extending from the first section and terminating with a face at an end of the second section distal to the first section, the face including: a flat section, and a grooved section having a concavity between a first edge and a second edge, the first edge and second edge defining a second axis midway between the first edge and second edge and parallel to the first edge and second edge such that the second axis intersects the central axis; and the handle extending from the structure of the first section in a first direction parallel to the central axis.

12. The hand tool of claim 11 further comprising:

a third section attached to the first section and extending away from the first section and the second section, the third section terminating in a third edge that is not parallel to the first edge and the second edge, the third section also extending in a second direction opposite the first direction such that at least part of the third section extends beyond both the first section and the second section in the second direction.

13. The hand tool of claim 12, wherein the third edge is skew in relation to the first edge and the second edge and central axis.

14. The hand tool of claim 11, wherein the flat section defines a first plane and the first edge and the second edge of the grooved section define a second plane and the first plane is at an angle with respect to the second plane.

15. The hand tool of claim 14, wherein the first plane is parallel to the first direction and the second plane is angled with respect to the first plane such that the grooved section extends further from the first section than the flat section.

16. The hand tool of claim 15, wherein a length of the flat section is at least ten percent of a length of the grooved section and no greater than fifty percent of the length of the grooved section.

17. The hand tool of claim 11, wherein:

a cross-section of the concavity between the first edge and the second edge and perpendicular to the second axis is one of: rounded, or v-shaped; and either or both the first edge and the second edge are one of: flat, blunt, or sharp.

* * * * *